United States Patent [19]

Zawadzki et al.

[11] Patent Number: 4,912,508

[45] Date of Patent: Mar. 27, 1990

[54] AUTOMATIC BACKGROUND CONTROL FOR AN ELECTROSTATIC COPIER

[75] Inventors: David T. Zawadzki, Rochester; Timothy W. Jacobs; Ravi Sampath, both of Fairport; John W. Prebola, Rochester, all of N.Y.

[73] Assignee: Xerox Corporation, Stamford, Conn.

[21] Appl. No.: 168,043

[22] Filed: Mar. 14, 1988

[51] Int. Cl.[4] ..... G03G 21/00

[52] U.S. Cl. ..... 355/208; 355/69; 355/214

[58] Field of Search ..... 355/3 R, 3 CH, 14 E, 355/69, 14 CH, 214, 208, 355–369

[56] References Cited

U.S. PATENT DOCUMENTS

| | | | |
|---|---|---|---|
| 3,788,739 | 1/1974 | Coriale | 355/14 E |
| 4,050,806 | 9/1977 | Miyakawa et al. | 355/14 |
| 4,153,364 | 5/1979 | Suzuki et al. | 355/14 E |
| 4,200,391 | 4/1980 | Sakamoto et al. | 355/14 E |
| 4,239,374 | 12/1980 | Tatsumi et al. | 355/14 E |
| 4,306,804 | 12/1981 | Sakamoto et al. | 355/14 E |
| 4,372,674 | 2/1983 | Yukawa et al. | 355/14 DR |
| 4,533,238 | 8/1985 | Miyazaki | 355/68 |
| 4,540,279 | 9/1985 | Irie et al. | 355/69 |
| 4,544,258 | 10/1985 | Takano | 355/1 |
| 4,564,287 | 1/1986 | Suzuki et al. | 355/14 CA X |
| 4,607,954 | 8/1986 | Osaka et al. | 355/3 R X |
| 4,647,184 | 3/1987 | Russell et al. | 355/14 CH X |
| 4,711,554 | 12/1987 | Nishimori | 355/14 E X |

*Primary Examiner*—Fred L. Braun

*Attorney, Agent, or Firm*—Ronald F. Chapuran

[57] ABSTRACT

A document background control system having a sensor in the optical path of a reproduction machine to sense the background of a document in the copy mode during the scanning of the document to adjust the illumination of the document and also includes a control to adjust the charging potential on the photoconductor in response to document background that is non-white.

3 Claims, 2 Drawing Sheets

AUTOMATIC BACKGROUND CONTROL FOR AN ELECTROSTATIC COPIER

This invention relates to electrophotographic machines and, more particularly, to the method and apparatus for compensating for original documents having a non-white background.

BACKGROUND OF THE INVENTION

In electrophotographic machines such as a zerographic copier, the documents that are copied may vary considerably in the actinic density of the paper substrate. White documents may have absolute densities that range from 0.04 to 0.20 depending on factors such as quality and age. Documents with colored or non-white backgrounds may have photo-topic densities as high as 0.50. In the absence of compensating techniques, a copier or printer designed to reproduce large areas responds to the absolute level of input density and hence, tends to produce unacceptable background when copying non-white background documents. Various compensating stabilization, are implemented to reduce the undesirable side effect of solid-area sensitivity. For example, it is known to provide manual background stabilization in the form of a range of copy-lighter/-copy-darker settings on the control panel of a copier. The high background from a non-white original is suppressed by selecting a copy-lighter mode which typically increases exposure, or developer bias, or a combination of the two. This technique has the disadvantage of being a hit or miss technique and causes considerable delays in the copying operation until the exact compensation settings are found for the particular document.

It is also known to provide various forms of automatic background stabilization. For example, the Minolta 350 copier uses a passive developer-bias control that increases bias when the average image potential increases. The 3M "Sensitron" copier increases exposure when the average reflectance across the process decreases. Both of these systems compensate for variations in substrate density for low-area-coverage documents but, undesirably, also compensate for areas of high-image density, mistaking the image density for background density. Another example of an automatic background stabilization technique is that found in the Canon NP-270F copier. For this technique, the scanning system performs a prescan of the document, sensing the background image potential with a built-in electrometer. Exposure is then adjusted prior to the actual exposure scan. This technique results in undesirable loss of productivity due to the extra time required for the process.

It is also known, as disclosed in pending application U.S. Ser. No. 901,990 filed Sept. 2, 1986, a continuation of U.S. Ser. No. 778,119 filed Sept. 20, 1985, now abandoned, titled Automatic Background Stabilization for an Electrophotographic Printing Machine, to sample the charged potential along the leading edge margin of an exposed image frame and in response to the sample measurements to select a corresponding specific set of document density and development bias values stored in memory to adjust the density of the developer applied to the background position of the latent image.

It is also known that the Apeco Electric Eye copier discloses automatic exposure control in which light reflected from the original irradiates a small rectangular slit at the side of the optical system housing. This slit is covered with a sheet of standard white paper and the light diffusely transmitted by this paper is then incident on a cadmium sulfide photocell placed outside the housing directly behind the paper covered slit. The output of the photocell is used to vary to voltage applied to the exposure lamps and thus vary the exposure. The 3M 545 machine discloses a system in which a photo sensor in the light path near the lens senses the light reflected from the original. When the amplitude of the light decreases or increases, the system causes the exposure lamp voltage to change accordingly, thus automatically compensating for the type of original being copied. It is known in U.S. Pat. No. 4,372,674 to generate a bias voltage based upon the sensed density and color of the background of an original to control a developer apparatus. U.S. Pat. No. 4.050,806 discloses a plurality of sensing electrodes to sense the background area of an electrostatic image and to apply a biasing voltage to the developing electrode in response to the lowest value of the sensed potential, and U.S. Pat. No. 4,306,804 discloses using a reference surface for a portion of an original document produced by reverse optical scanning to sense the electrostatic potential on a photoconductive member to control the intensity of the light image of the original document or the developing bias voltage. In addition U.S. Pat. Nos. 4,200,391, 4,533,238 and 4,544,258 generally describe exposure control but not scorotron control in an attempt to eliminate a leading edge black band.

Difficulties with the above-described systems are that they often require prescanning of originals before copying and in those systems where adjustment is on the fly, a dark lead edge band may often appear on the copy. Also, in reproducing two up originals such as in a book mode or split scan mode, the sensor is not able to measure a signal corresponding to each of the two originals.

Accordingly, it is an object of the present invention to provide a new and improved background control that includes a sensor positioned within the optical path in order to view the original through the scanning optics to automatically adjust the illumination of the document on the fly. It is another object of the present invention to adjust the scorotron grid potential prior to scanning the original in response to a non-white document background to reduce the developability of low density originals and prevent a lead edge band from appearing on the copy. Further objects of the present inventions will become apparent as the following description proceeds and the features of novelty characterizing the invention will be pointed out with particularity in the claims annexed to and forming a part of this specification.

SUMMARY OF THE INVENTION

Briefly, the present invention is a document background control system having a sensor in the optical path of a reproduction machine to sense the background of a document in the copy mode during the scanning of the document to adjust the illumination of the document and also includes the means to adjust the charging potential on the photoconductor to provide suitable copies.

Other aspects of the present invention will become apparent as the following description proceeds and upon reference to the drawings in which like numerals refer to like parts and wherein.

DESCRIPTION OF THE PREFERRED EMBODIMENT

Figure 1:
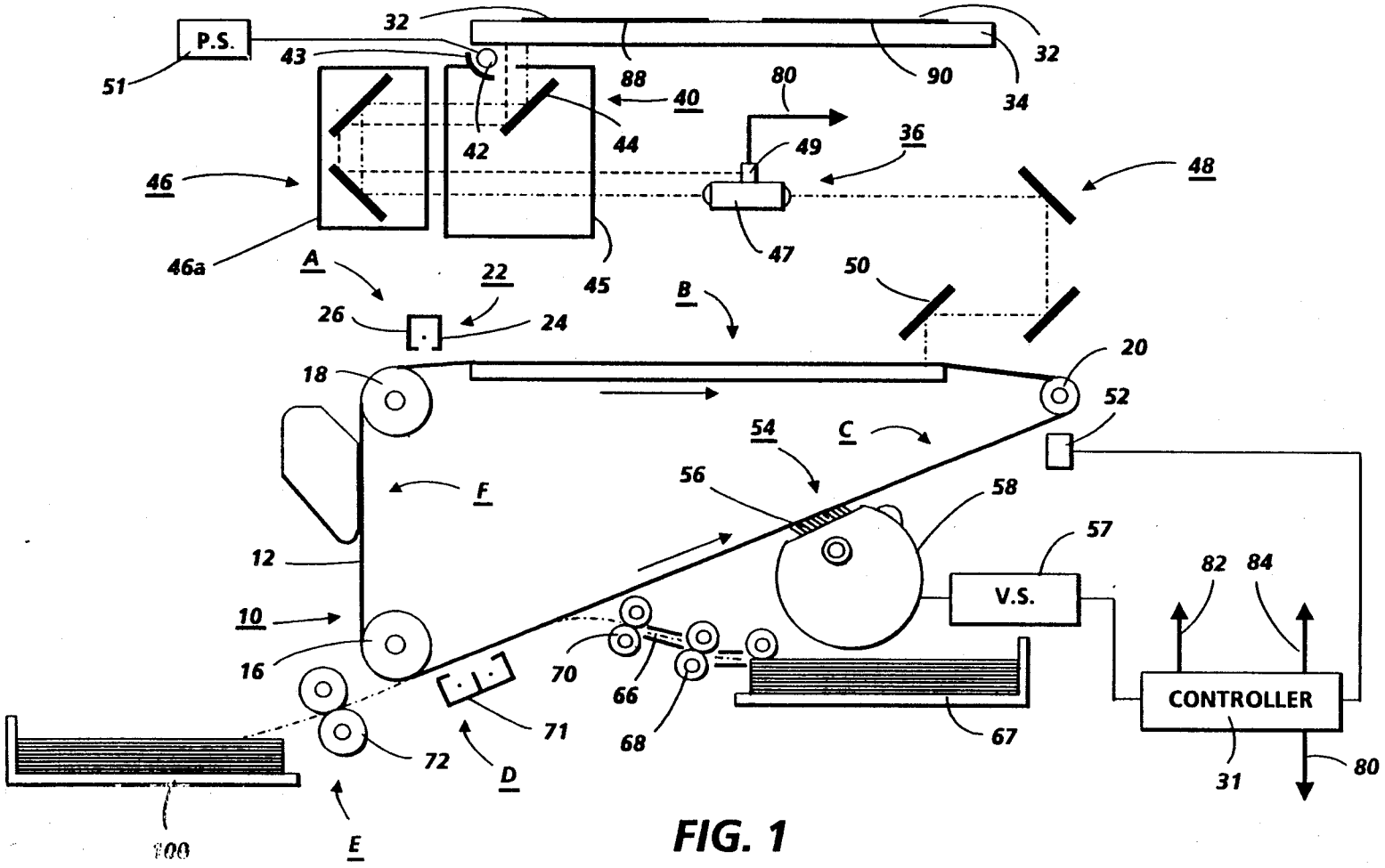
FIG. 1 is a side schematic view of an electrophotographic printing machine incorporating the features of the present invention.

FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its applications to the particular embodiment shown herein. Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine used a photoreceptor belt 10 having a photoconductive surface 1 formed on a conductive substrate. Belt 10 moves in the indicated direction, advancing sequentially through the various xerographic process stations. The belt is entrained about drive roller 16 and tension rollers 18, and 20. Roller 16 is driven by conventional motor means (not shown).

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26. A high voltage supply controlled by a portion of controller 31, is connected to shield 26.

As the belt continues to advance, the charged portion of surface 12 moves into exposure station B. An original document 32 is positioned, either manually or by a document feeder mechanism (not shown) on the surface of a transparent platen 34. Optics assembly 36 contains the optical components which incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath the platen. Lamp 42 illuminates an incremental line portion of documents 32. The reflected image is reflected by scan mirror 44 to mirror assembly 46 on a second scan carriage 46A moving at ½ the rate of mirror 44.

The document image is projected through lens 47 and reflected by a second mirror 48 and belt mirror 50, both moving at a predetermined relationship so as to proceed the projected image while maintaining the required rear conjugate onto surface 12 to form thereon an electrostatic latent image corresponding to the informational area contained within original document 32. In accordance with the present invention, an optical sensor 49 connected to controller 31 is disposed near lens 47 in the optical path of the image projected from original document 32. Adjustable illumination power supply 51, controlled by a portion of controller 31, supplies power to lamp 42.

The belt then advances past a DC electrometer 52 positioned adjacent to the photoconductive surface 12 between the exposures station B and development station C to generate a signal proportional to the dark development potential on the photoconductive surface. The dark development potential is the charge maintained on the photoconductor after charging and exposure, reflected from an opaque target or object. Preferably, the electrometer 52 is a nulling type device having a (not shown) probe and head assembly and the potential of the head and probe assembly is raised to the potential of the surface being measured. The generated signal is conveyed to controller 31 through suitable conversion circuitry. The controller 31 is also electrically connected to a (not shown) high voltage power supply through suitable logic interface to control the bias voltage on the conductive shield 26 of the charging corotron in response to the generated signal from the electrometer 52 to adjust the dark development potential.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material deforms belt 10 in an arc with the belt conforming, at least partially, to the configuration of the developer material. The electrostatic latent image attracts the toner particles from the carrier granules forming a toner powder image on photoconductive surface 12. As successive latent images are developed, toner particles are depleted from the developer material. A toner particle dispenser, indicated generally by the reference numeral 60 provides additional toner particles to housing 58 for subsequent use by developer roller 56. Toner dispenser 60 includes a container for storing a supply of toner particles therein and means (not shown) for introducing the particles into developer housing 58.

An output copy sheet 66 taken from a supply tray 67, is moved into contact with the toner powder image at transfer station D. The support material is conveyed to station D by a pair of feed rollers 68 and 70. Transfer station D includes a corona generating device 71 which sprays ions onto the back side of sheet 66, thereby attracting a toner powder image from surface 12 to sheet 66. After transfer, the sheet advances to fusing station E where a fusing roller assembly 72 affixes the transferred powder image. After fusing, sheet 66 advances to an output tray (not shown) for subsequent removal by the operator. After the sheet of support material is separated from belt 10, the residual toner particles are removed at cleaning station F.

Figure 2:
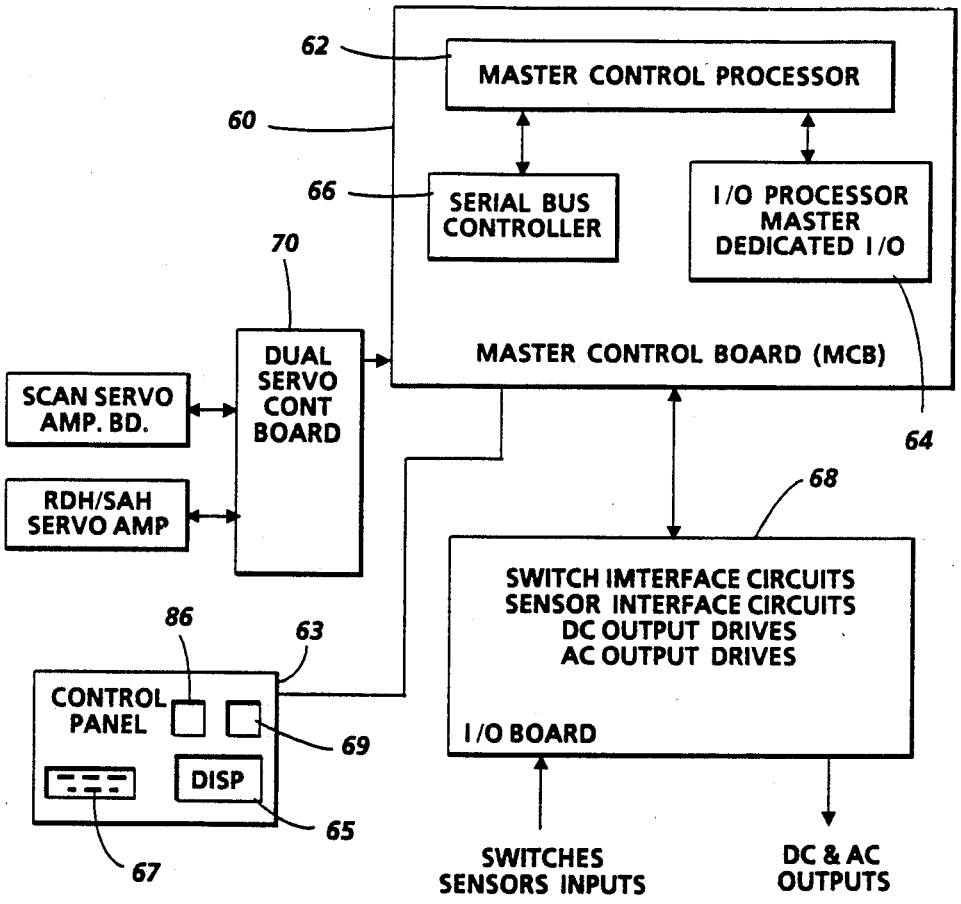
FIG. 2 is a schematic block diagram of the control circuitry for implementing the present invention.

With reference to FIG. 2, there is illustrated the general control of the xerographic printing machine. In particular, the controller 31 includes a master control board 60, including an Intel 8085 master control processor 62, an Intel 8085 input/output processor 64 and a serial bus controller 66 connected to an input/output board 68 including various switch and sensor interface circuits and DC and AC output drivers. In a preferred embodiment the master control processor includes 80K ROM, 8K RAM and 2K MBM memories and suitable timing and reset circuitry. The input/output processor includes 8K ROM, 2K RAM, AD and DA converters and an 8253 timer and 8259 interrupt controller, as well as suitable input and output ports. The master control board 60 is also connected to a dual servo control board 70 over a serial bus for handling scan and document handling servos. Also, connected to the master control board 60 is a control panel 63 with suitable display 65 and key board 67 for entering program data and displaying control and diagnostic information. In particular, in accordance with the present invention, the control panel includes a non-white background or colored original switch 69.

Figure 3:
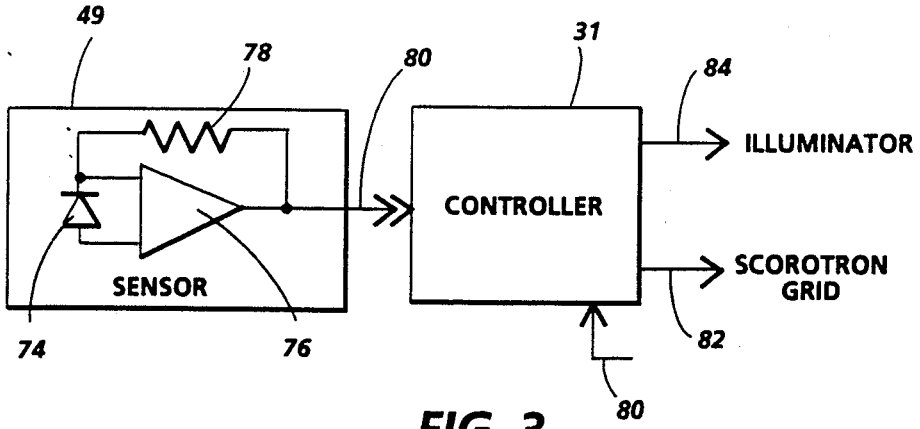
FIG. 3 illustrates the sensor and control response in accordance with the present invention.

With reference to FIG. 3, there is illustrated the sensor 49 in more detail in accordance with the present invention. Preferably, the optical sensor 49 includes a blue sensitive photodiode 74, amplifier 76, and resistor 78 supported on a (not shown) printed circuit board. Preferably the optical sensor 49 is mounted to the frame of the machine generally shown in FIG. 1 at a location near the lens 47 in the optical path of the light rays reflected from a document on platen 34. The signal 80 from the optical sensor 49 is suitable conveyed to the controller 31, in turn providing illuminator signal 84 to the power supply 51 of lamp 43. Also, in response to the activation of switch 69 on control panel 63 by an operator, a suitable scorotron grid signal, signal 82, is conveyed by controller 31 to the corona generating device 22.

Since the optical sensor 49 is positioned in the optical path, in effect, the sensor views a segment or portion of a document on the platen 34 as it is scanned by the illumination scan assembly 40. This allows the sensor to view the entire length of the platen 34 and any documents supported on the platen. That is by a suitable timing signal from the controller 31 the sensor 49 will provide the signal 80 to the controller at any preselected or designated location along the platen and thus along a document to be scanned.

In operation, the background correction or non-white background switch 69 located on control panel 63 electrically connected to controller 31 is activated upon the determination that a non-white background document is to be copied. In response to the activation of the background control switch, the master control processor 62 provides signal 82 to the corona generating device 22, preferably to the grid of a scorotron, to reduce the charging potential to the belt 10 prior to scanning the original by the illumination scan assembly 40. The reduction of the scoroton grid potential has the effect of reducing the developability of low density originals or non-white (colored) originals. At the start of scan by the illumination scan assembly 40, in accordance with the present invention, the reduced scorotron grid potential prevents a lead edge band from appearing on the copy sheet. That is, the lead edge band is masked. As the first original is scanned, the optical sensor 49 determines the degree or amount of background and/or color of the original and this information via signal 80 is read by the controller 31, in particular the master control processor 62. In response, the master control processor 62 provides a output signal 84 via the input/output board 68 or power supply 51 to adjust the illumination level of lamp 43 to further eliminate the background that will appear on the copy sheet.

It should be apparent that in the above-described system no prescanning of the original is required before the copy operation is initiated. Also, in systems adapted for copying two originals as illustrated by originals 88 and 90 in FIG. 1, (often known as a book mode or split scan mode of copying) the timing signals from the master controller 62 on the master control board 60 can provide suitable timing signals in order that the background of each of the documents 88 and 90 can be measured by sensor 49 and on the fly corrections made to the lamp 42 during the scan operation. In a preferred embodiment at the beginning of the scan of a document a reading is taken of a top portion of the document 7 millimeters wide by 70 millimeters in length. the background is sensed by optical sensor 49 to adjust the exposure lamp 42 to fine tune or complete the masking of the background for the remainder of the scan of the document in coordination with the reduction of the bias potential to the charging device 22.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

We claim:

1. A reproduction apparatus including:

a moving photoconductive member, charging means to produce a first potential on the photoconductive member, illuminating means for illuminating an original document having a background area and an image area, optical means for focusing a light image of the original document onto the photoconductive member, the document and the optical means mounted for relative movement, sensor means in the optical path of the optical means for sensing the optical density of the lead portion of the document during illumination, and control means to control the illumination of the background area, the improvement comprising on the fly means responsive to sensing of the lead portion of the document during the illumination to adjust the illuminating means, and means to adjust the charging means to produce a second potential on the photoconductive member during the illumination of the original document.

2. Reproduction apparatus including:

a moving photoconductive member, illuminating means for illuminating an original document having a background area and an image area, photoconductor charging means providing a first charging potential for original documents having a white background area, optical means for focusing a light image of the original document onto the photoconductive member, the original document being scanned by the optical means during a reproduction of a copy of the original, sensor means for sensing the optical density of the background area during illumination, and control means to control the illumination of the background area, the improvement comprising on the fly means to sense a selective portion of the background area of the document during the illumination of the document and adjust the illuminating means and means for changing the photoconductor charging means to provide a second charging potential in response to an original document having a nonwhite background area, the second charging potential being less than the first charging potential.

3. The apparatus of claim 2 wherein the lead portion of the document is sensed to adjust the illuminating means during the reproduction.

* * * * *